US008285181B2

(12) United States Patent
Saito

(10) Patent No.: US 8,285,181 B2
(45) Date of Patent: Oct. 9, 2012

(54) IMAGE FORMING APPARATUS HAVING LESS DECREASE IN PRIMARY TRANSFER EFFICIENCY OF TONER IMAGE

(75) Inventor: Jun Saito, Toyokawa (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 318 days.

(21) Appl. No.: 12/726,090

(22) Filed: Mar. 17, 2010

(65) Prior Publication Data

US 2010/0239333 A1 Sep. 23, 2010

(30) Foreign Application Priority Data

Mar. 18, 2009 (JP) ..... 2009-066719

(51) Int. Cl.
*G03G 15/01* (2006.01)

(52) U.S. Cl. ..... 399/299; 399/162; 399/165

(58) Field of Classification Search ..... 399/162, 399/165, 166, 299, 300
See application file for complete search history.

(56) References Cited

U.S. PATENT DOCUMENTS 6,470,166 B2 * 10/2002 Mizoguchi et al. ..... 399/302
7,751,762 B2 7/2010 Hatayama et al.
2007/0116497 A1 * 5/2007 Yamazaki ..... 399/299
2007/0134028 A1 * 6/2007 Funabashi ..... 399/299
2007/0183816 A1 8/2007 Hatayama et al.

FOREIGN PATENT DOCUMENTS

| | | |
|---|---|---|
| JP | 7-36294 | 2/1995 |
| JP | 11-338264 | 12/1999 |
| JP | 2007-199626 | 8/2007 |
| JP | 2009-20321 | 1/2009 |

OTHER PUBLICATIONS

Japanese Notification of Reasons for Refusal mailed Jan. 5, 2011, directed to counterpart Japanese Patent Application No. 2009-066719; 6 pages.

* cited by examiner

*Primary Examiner* — Walter L Lindsay, Jr.
*Assistant Examiner* — Roy Y Yi
(74) *Attorney, Agent, or Firm* — Morrison & Foerster LLP

(57) ABSTRACT

The decrease of the transfer efficiency of transferring a toner image from a photosensitive drum onto an intermediate transfer belt is suppressed by the structure of an image forming apparatus including: a photosensitive drum holding member that pivotally supports the photosensitive drum at both ends thereof; a transfer roller holding member that pivotally supports a primary transfer roller at both ends thereof; and a transfer roller holding unit that determines a relative position between the photosensitive drum holding member and the transfer roller holding member by guiding the transfer roller holding member in a direction substantially perpendicular to a running surface of the belt and abutting an opposing part of the photosensitive drum holding member and an opposing part of the transfer roller holding member with each other, the opposing parts opposing each other.

8 Claims, 12 Drawing Sheets

130
136
132c
132d
134
133a
132b
133
133t
131a
131Y
31Y
H1
B
D
C
C'
C ⇧ C'
C ⇧ C''
C ⇧ C'''
D ⇧ D'
D ⇧ D''
X
X'
Z
Z'

IMAGE FORMING APPARATUS HAVING LESS DECREASE IN PRIMARY TRANSFER EFFICIENCY OF TONER IMAGE

This application is based on application No. 2009-066719 filed in Japan, the content of which is hereby in incorporated reference.

BACKGROUND OF THE INVENTION (1) Field of the Invention

The present invention relates to an image forming apparatus employing an electrophotographic system that includes an intermediate transfer belt.

(2) Related Art

In recent years, as a full-color image forming apparatus, there has been widely used an image forming apparatus employing a so-called intermediate transfer system in which toner images of respective colors formed on a photosensitive drum are primarily transferred onto an intermediate transfer belt, respectively, and then the toner images overlaid on the intermediate transfer belt are secondarily transferred onto a recording sheet collectively.

According to such an image forming apparatus, primary transfer of the toner images formed on the photosensitive drum onto the intermediate transfer belt is performed in the following manner. A transfer roller is provided at a position substantially opposing the photosensitive drum with the intermediate transfer belt sandwiched between the transfer roller and the photosensitive drum. The transfer roller is pressed to an inner circumferential surface of the intermediate transfer belt. While a surface of the intermediate transfer belt is brought in contact with the photosensitive drum at an appropriate pressure, a predetermined transfer voltage is applied to the transfer roller to cause the toner images formed on the photosensitive drum to be electrostatically adsorbed to the intermediate transfer belt.

The transfer efficiency decreases due to each of a too high contact pressure and a too low contact pressure between the photosensitive drum and the intermediate transfer belt. Accordingly, it is necessary to set the contact pressure with a high accuracy.

On the other hand, there has been recently used an image forming apparatus in which a relative position is slightly offset between a transfer roller and a photosensitive drum in a running direction of an intermediate transfer belt, and a long distance is set between a first contact position where the transfer roller contacts with the intermediate transfer belt and a second contact position where the photosensitive drum contacts with the intermediate transfer belt.

There is a recent tendency that such an image forming apparatus adopts the structure in which the resistance value between the first contact position and the second contact position is increased to increase the voltage difference between the transfer roller and the photosensitive drum, thereby to increase the electrical field intensity and keep a high transfer efficiency (hereinafter, "offset type structure").

According to an image forming apparatus having the offset-type structure, as shown in FIG. 12A, at each end of the transfer roller 1035, a disk-shaped rollers 1034 each having an outer diameter greater than an outer diameter of the transfer roller 1035 is provided coaxially with an axis of the transfer roller 1035. The rollers 1034 each abut with a non-image region located at each end of an outer circumferential surface of a photosensitive drum 1031.

In this way, the image forming apparatus having the offset-type structure keeps a constant distance between the photosensitive drum 1031 and the transfer rollers 1035 and keeps a constant value of a press stroke L11 of an intermediate transfer belt 1011, thereby to ensure the contact pressure with a high accuracy.

Here, the photosensitive drum 1031 is pivotally supported by a pair of first holding members 1132.

On the other hand, the transfer roller 1035 and the rollers 1034 are each pivotally supported at ends of a pair of second holding members 1036 that swing around a swing shaft 1036*a*.

The second holding members 1036 are forced toward the photosensitive drum 1031 by a spring (not shown) or the like.

With such a structure, the rollers 1034 abut with the non-image regions located at the both ends of the outer circumferential surface of the photosensitive drum 1031.

The photosensitive drum 1031 is generally structured so as to be removable in consideration of maintenance and the like.

Accordingly, there are variations in the accuracy of assembling and the dimensional accuracy of components, for example. This tends to cause a relative positional offset between the first holding members 1132 holding the photosensitive drum 1031 and the second holding members 1036 holding the transfer roller 1035 and the rollers 1034.

For example, as shown in FIG. 12B, in the case where an offset occurs between the rotation axis 1031*a* and the swing shaft 1036*a* in the horizontal direction (X-axis direction) and the position of the swing shaft 1036*a* shifts from P1 to P1', the abutting position where the rollers 1034 abut with the photosensitive drum 1031 shifts from P3 to P4 and the value of the press stroke of the intermediate transfer belt 1011 applied by the transfer roller 1035 increases from L11 to L12.

Also, as shown in FIG. 12C, in the case where an offset occurs between the rotation axis 1031*a* and the swing shaft 1036*a* in the perpendicular direction (Z-axis direction) and the position of the swing shaft 1036*a* shifts from P1 to P1", the abutting position where the rollers 1034 abut with the photosensitive drum 1031 shifts from P3 to P5 and the value of the press stroke of the intermediate transfer belt 1011 applied by the transfer roller 1035 decreases from L11 to L13.

In this way, in the case where a relative positional offset occurs between the first holding members 1132 and the second holding members 1036, the press stroke of the intermediate transfer belt 1011 varies. This makes it difficult to set the contact pressure between the photosensitive drum and the intermediate transfer belt within an appropriate range. Accordingly, the transfer efficiency might decrease.

SUMMARY OF THE INVENTION

The present invention is made in view of the above problem, and aims to provide an image forming apparatus having less decrease in transfer efficiency even in the case there occurs a relative positional offset between of a holding member for an image carrier such as a photosensitive drum and a holding member for a transfer roller.

The above aims is achieved by an image forming apparatus that transfers a toner image from an image carrier rotary body provided outside an outer circumferential surface of a running belt onto the outer circumferential surface with use of a transfer roller that contacts with an inner surface of the belt, the image forming apparatus comprising: a first holding member that rotatably holds the image carrier rotary body; a second holding member that rotatably holds the transfer roller; and a position determining unit operable to determine a relative position between the image carrier rotary body and the transfer roller, by guiding one of the first and second holding members in a direction substantially perpendicular to a running surface of the belt, and abutting a first part of the first holding member and a second part of the second holding member with each other, the first part and the second part opposing each other, wherein when viewed in an axis direction of the transfer roller, one of the first and second parts has a straight linear outline parallel to a running direction of the belt, and the other of the first and second parts has a convex curved outline, and the position determining unit includes: a guide member having a reference surface extending in the direction substantially perpendicular to the running surface of the belt; a first forcing member operable to force, toward the reference surface, one of the first and second holding members to be guided, so as to be brought in contact with the reference surface; and a second forcing member operable to force, toward the other holding member, the one holding member to be guided.

BRIEF DESCRIPTION OF THE DRAWINGS

These and other objects, advantages and features of the invention will become apparent from the following description thereof taken in conjunction with the accompanying drawings that illustrate a specific embodiment of the invention.

In the drawings.

DESCRIPTION OF PREFERRED EMBODIMENTS

Figure 1:
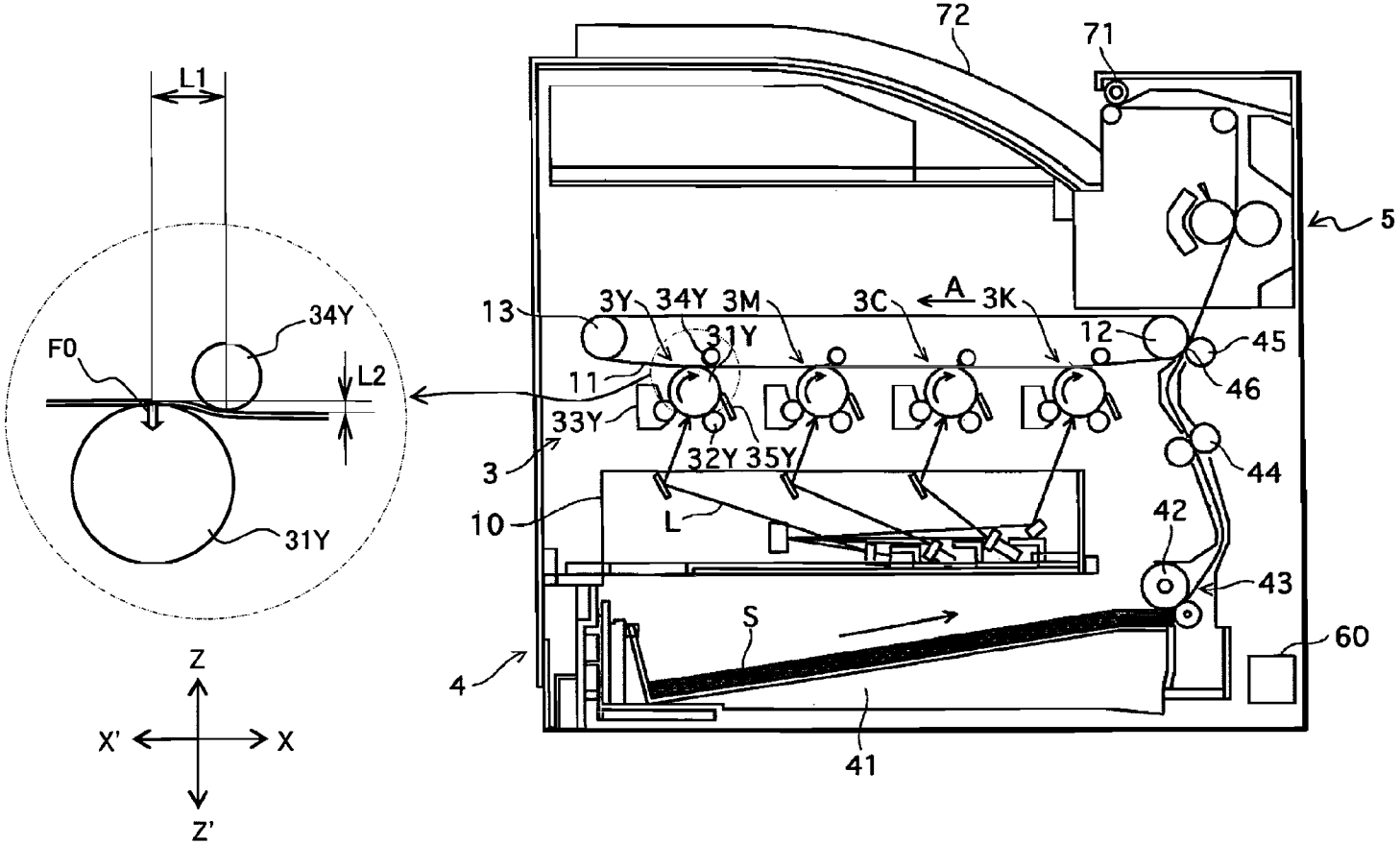
FIG. 1 is an outline cross-sectional view showing a whole structure of a printer relating to an embodiment of the present invention.

FIG. 1 is an outline cross-sectional view showing a whole structure of a printer 1 relating to an embodiment of the present invention.

As shown in FIG. 1, the printer 1 includes an image processing unit 3, a paper feed unit 4, a fixing unit 5, and a control unit 60. The printer 1 is a so-called tandem-type color printer, and is connected with a network (for example, LAN). Upon receiving an instruction to execute a print job from an external terminal apparatus (not shown), the printer 1 forms a toner image composed of colors of yellow, magenta, cyan, and black in accordance with the received instruction, and performs full-color image formation by multiple-transferring the formed toner images.

Hereinafter, the yellow, magenta, cyan, and black reproduction colors will be represented as Y, M, C, and K, respectively, and the letters Y, M, C, and K will be appended to reference numbers of components relating to the reproduction colors.

<Image Processing Unit>

The image processing unit 3 includes image forming units 3Y, 3M, 3C, and 3K respectively corresponding to the colors of Y, M, C, and K, an optical unit 10, an intermediate transfer belt 11, and so on.

The image forming unit 3Y includes a photosensitive drum 31Y as an image carrier rotary body, a charger 32Y, a developer 33Y, and a primary transfer roller 34Y, a cleaner 35Y for cleaning the photosensitive drum 31Y, and so on. The charger 32Y, the developer 33Y, and the primary transfer roller 34Y are disposed surrounding the photosensitive drum 31Y.

The image forming unit 3Y forms a Y-toner image on the photosensitive drum 31Y. Other image forming units 3M-3K have the same structure as the image forming unit 3Y, and accordingly the signs thereof are omitted in FIG. 1.

The intermediate transfer belt 11 is an endless belt. The intermediate transfer belt 11 stretches and lays on a driving roller 12 and a driven roller 13, and is driven to rotate in a direction of an arrow A.

The optical unit 10 includes a light emitting element such as a laser diode. The optical unit 10 emits laser light L for forming Y, M, C, and K images in response to a driving signal output from the control unit 60, and causes the photosensitive drums 31Y-31K to be exposure-scanned.

As a result performing this exposure-scanning, an electrostatic latent image is formed on the photosensitive drums 31Y-31K respectively charged by the chargers 32Y-32K. The static latent images are respectively developed by the developers 33Y-33K.

The Y-K toner images respectively developed on the photosensitive drums 31Y-31K are primarily transferred at predetermined intervals such that all the toner images of the respective colors are superimposed on top of one another at the same position on the intermediate transfer belt 11.

The toner images of the respective colors are transferred onto the intermediate transfer belt 11 due to an electrostatic force acting on the primary transfer rollers 34Y-34K. As a result, a full color toner image is formed.

Furthermore, with rotation of the intermediate transfer belt 11, the toner image moves in a direction of a secondary transfer position 46.

For example, an electrostatic force acting on the primary transfer roller 34Y decreases or increases depending on a potential difference between the primary transfer roller 34Y and the photosensitive drum 31Y. Here, each of the primary transfer roller 34Y-34K is an inexpensive low-resistance metallic roller. Since each of the primary transfer rollers 34Y-34K does not have an insulating layer on a surface thereof, it is necessary to set a high resistance of the intermediate transfer belt 11 provided between the photosensitive drum 31Y and the primary transfer roller 34Y in order to sufficiently secure the above potential difference.

Accordingly, the printer 1 relating to the embodiment has the structure in which the position of the primary transfer roller 34Y is offset in a running direction of the intermediate transfer belt 11 (X-X' direction) with respect to the photosensitive drum 31Y corresponding to the primary transfer roller 34Y. A value of an offset amount L1 is approximately 4 mm.

Furthermore, the primary transfer roller 34Y presses the intermediate transfer belt 11 by a length corresponding to the press stroke L2 in a direction Z' perpendicular to a running surface of the intermediate transfer belt 11.

Also, the same structure applies to the photosensitive drums 31M-31K and the primary transfer rollers 34M-34K.

Here, the above press stroke L2 preferably falls within a range of 0.01 mm to 0.12 mm so as to maintain a preferable primary transfer efficiency.

On the other hand, the paper feed unit 4 includes a paper feed cassette 41 housing therein pieces of recording sheets S, a pickup roller 42 picking up the recording sheets S housed in the paper feed cassette 41 and directing the recording sheets S onto a convey path 43 piece by piece, a timing roller pair 44 adjusting a timing of sending the recording sheets S out to the secondary transfer position 46, and so on. In accordance with the timing of the toner image moving on the intermediate transfer belt 11, a recording sheet S is fed from the paper feed unit 4 to the secondary transfer position. The toner images on the intermediate transfer belt 11 are secondarily transferred collectively onto the recording sheet S by the secondary transfer roller 45. The recording sheet S that has passed by the secondary transfer position 46 is conveyed to the fixing unit 5. The toner image (unfixed image) on the recording sheet S is heated and pressurized so as to be fixed to the recording sheet S.

The recording sheet S is ejected on an output tray 72 via an eject roller 71.

<Holding Mechanism for Photosensitive Drum and Primary Transfer Roller>

The printer 1 relating to the embodiment is characterized in the holding mechanism for the photosensitive drums 31Y-31K and the primary transfer rollers 34Y-34K.

Figure 2:
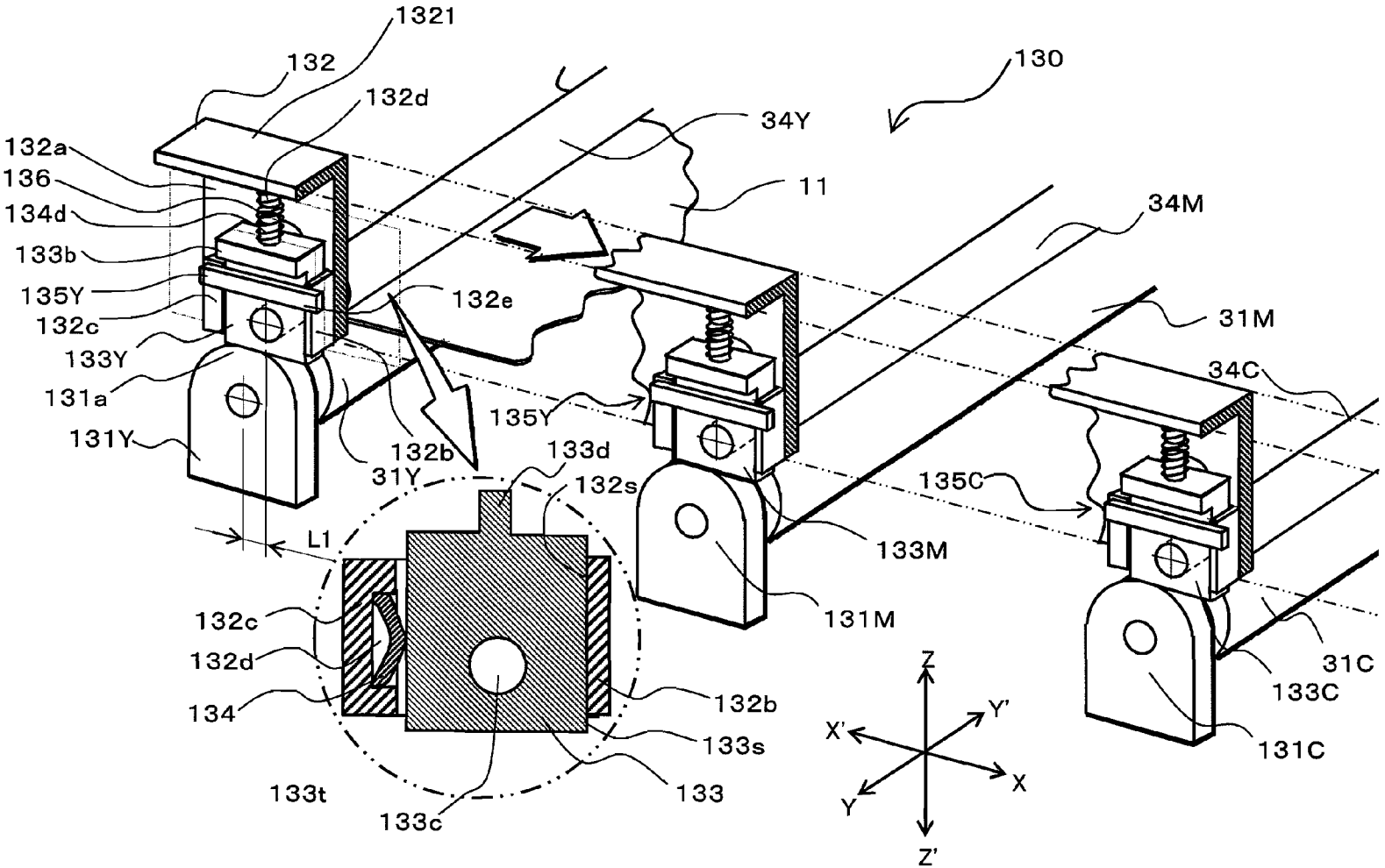
FIG. 2 is a partly-broken view showing a holding mechanism of a photosensitive drum and a primary transfer roller relating to the embodiment of the present invention.

FIG. 2 is a partly-broken view showing the above holding mechanism.

Note that the above holding mechanism has a symmetric configuration in the Y-Y' direction, and FIG. 2 shows part of the configuration when viewed from the Y direction side.

<Holding Mechanism of Primary Transfer Rollers 34Y-34K>

The primary transfer rollers 34Y-34K are held at both ends thereof by a transfer roller holding mechanism 130 via the transfer roller holding members 133Y-133K, respectively.

The transfer roller holding members 133Y-133K support both ends of the primary transfer rollers 34Y-34K such that the primary transfer rollers 34Y-34K are pivotable, respectively. The transfer roller holding members 133Y-133K are also held so as to be slidable in the Z-Z' direction with respect to a frame 132.

In other words, guide units 135Y-135K are provided at predetermined distances in the frame 132 in a belt running direction. The guide units 135Y-135K respectively hold the transfer roller holding members 133Y-133K so as to be slidable in the Z-Z' direction.

For example, the guide unit 135Y has the structure in which a pair of guide members 132*b* and 132*c* are provided upright on a side surface 132*a* of the frame 132, the transfer roller holding member 133Y is slidably inserted between the pair of guide members 132*b* and 132*c*, and a bar member 132*e* is provided so as to hang between a side edge of the guide members 132*b* and 132*c* in FIG. 2 such that the transfer roller holding member 133Y does not protrude toward the front side in FIG. 2.

Note that, in consideration of the molding accuracy of the transfer roller holding member 133Y and the frame 132, the width of the transfer roller holding member 133Y in the X-X' direction is set smaller than the distance between the guide members 132*b* and 132*c* by approximately 100 μm. The distance of a space between the bar member 132*e* and the transfer roller holding member 133Y is also set smaller than the distance between the guide members 132*b* and 132*c* by approximately 100 μm.

The transfer roller holding member 133Y is substantially a rectangular solid having a height of 16 mm in the Z-axis direction, a depth of 6 mm in the Y-axis direction, and a width of 11 mm in the X-axis direction. A stopper part 133*b* is formed above an upper side of the transfer roller holding member 133Y. The transfer roller holding member 133Y is designed so as not drop during assembly, by abutting the stopper part 133*b* with the bar member 132*e* beyond a predetermined range.

Also, the transfer roller holding member 133Y has a bearing hole 133*c* in a part that is a bit below the center of the stopper part 133*b*, which rotatably holds a shaft of the primary transfer roller 34Y.

The transfer roller holding member 133Y is preferably made of a resin material having excellent slidability, molding accuracy, and mechanical strength, such as POM (polyacetal) and PPS (Polyphenylenesulfide).

The guide member 132*b* is formed in the guide unit 135Y so as to have a planar surface perpendicular to the running surface of the intermediate transfer belt 11.

As shown in an enlarged sectional view encircled by a two-dot chain line in FIG. 2, an internal surface of the guide member 132*b* on the right in the guide unit 135Y is structured so as to be slidable while a right flat surface 133*s* of the transfer roller holding member 133Y is always kept in contact with a reference surface 132*s*, by providing a plate spring 134 in a concave part 132*d* formed on an internal surface of the guide member 132*c* on the left in the guide unit 135Y and forcing the transfer roller holding member 133Y toward the guide member 132*b*.

The plate spring 134 is preferably made of a resin material having excellent elasticity and slidability, such as POM (polyacetal) and PC (Polycarbonate).

On a top surface of the transfer roller holding member 133Y, a convex part 133*d* having a cylindrical shape is provided. One of ends of a compression coil spring 136 is fit to the convex part 133*d*.

On the other hand, the frame 132 is arranged such that lateral surfaces thereof are located on the X-Z planar surface. The frame 132 has a cross section having a substantially inverted L-shape, and has a horizontal part 1321 on a top part thereof, which extends outward in the horizontal direction. On a part of a low surface of the horizontal part 1321 that opposes the convex part 133*d*, a convex part 132*d* having a cylindrical shape is provided. The other one of the ends of the compression coil spring 136 is fit to the convex part 132*d*. Accordingly, the compression coil spring 136 forces the transfer roller holding member 133Y downward while the position of the compression coil spring 136 is fixed.

Although the description has been provided with respect to only the holding mechanism of the transfer roller holding member 133Y, other transfer roller holding members 133M-133K have the same mechanism as the transfer roller holding member 133Y, and accordingly descriptions thereof are omitted here.

<Holding Mechanism of Photosensitive Drums 31Y-31K>

The photosensitive drums 31Y-31K are held at both ends thereof by photosensitive drum holding members 131Y-131K, respectively (FIG. 2 shows only the photosensitive drum holding members 131Y-131C in the front side among the photosensitive drum holding members 131Y-131K).

In the embodiment, the photosensitive drums 31Y-31K are housed in resin cases (not shown) respectively, and unitized for simplification of maintenance. The photosensitive drums 31Y-31K are each structured so as to be removable along a guide member (not shown) provided in the Y-Y' direction of the printer 1. The photosensitive drum holding members 131Y-131K are integrally provided in the resin cases.

An aperture is formed in a part of the resin case that opposes the intermediate transfer belt 11. While the photosensitive drums 31Y-31K are stabilized in the printer 1, the circumferential surfaces of the photosensitive drums 31Y-31K can be in contact with the intermediate transfer belt 11 and the transfer roller holding members 133Y-133K can be in contact with the photosensitive drum holding members 131Y-131K, respectively.

Also, when viewed in the axis direction of the primary transfer roller 34Y (Y-Y' direction), top parts of the photosensitive drum holding members 131Y-131K are each formed so as to have a circular arc that is concentric with the shaft of the photosensitive drums 31Y-31K and has the same radius as the photosensitive drums 31Y-31K.

Circular parts 131*a* that are the top parts of the photosensitive drum holding members 131Y-131K abut with bottom surfaces 133*t* of the transfer roller holding members 133Y-133K, respectively. This determines the relative positions between the photosensitive drum 31Y-31K and the transfer roller holding members 133Y-133K, respectively.

As a result, it is possible to strictly set the press stroke L2 of the intermediate transfer belt 11 applied by the primary transfer rollers 34Y-34K (see FIG. 1), and appropriately set the contact pressure between each of the photosensitive drums 31Y-31K and the intermediate transfer belt 11.

The following describes the above mechanism taking the photosensitive drum holding member 131Y and the transfer roller holding member 133Y as an example.

Figures 3A, 3B, 3C, 3D:
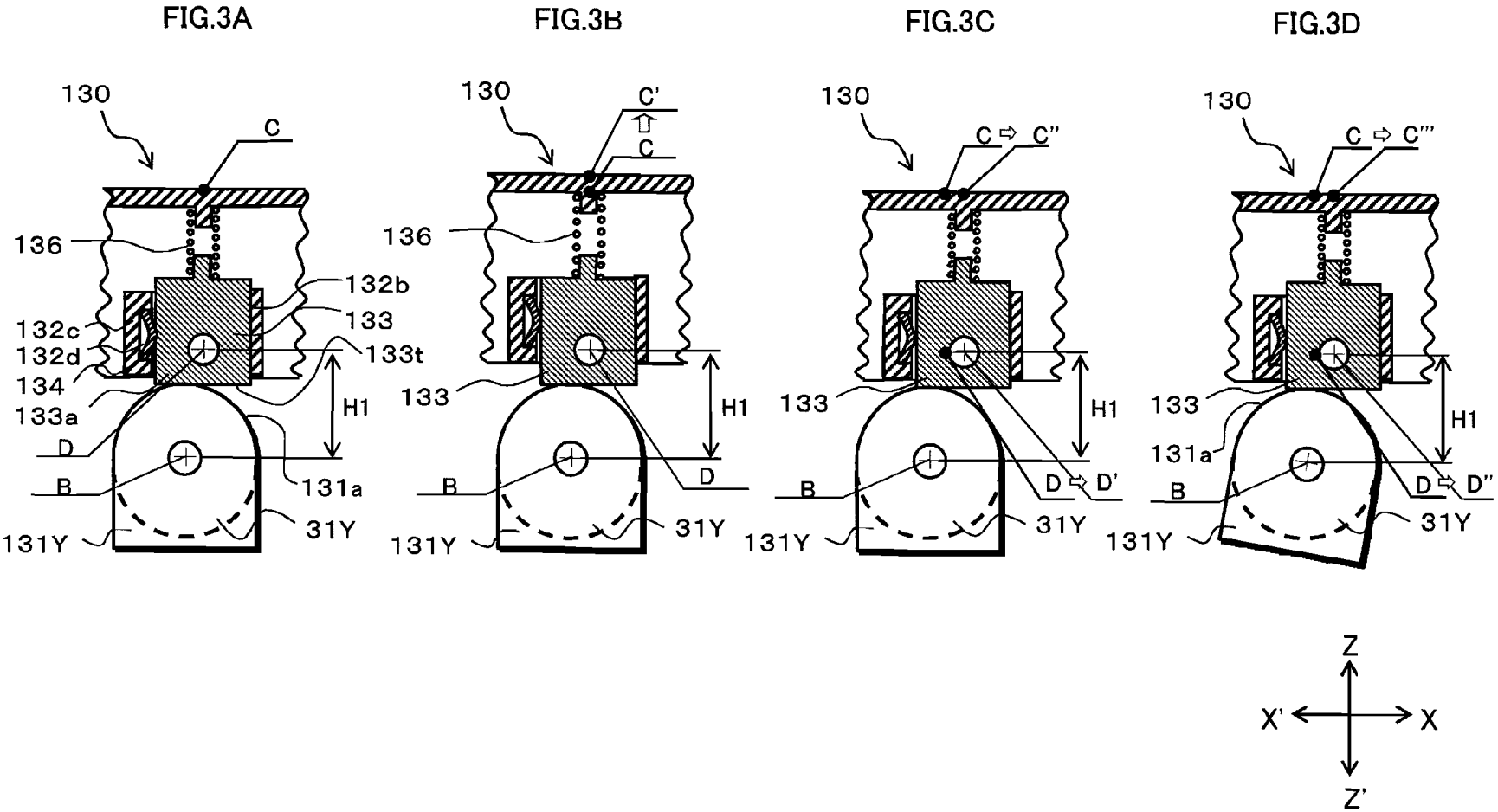
FIG. 3A, FIG. 3B, FIG. 3C, and FIG. 3D each show a vertical distance between a holding member for the photosensitive drum and a holding member for the primary transfer roller relating to the embodiment of the present invention that are in a different relative position.

FIG. 3A shows a case where the relative position between the photosensitive drum holding member 131Y and the transfer roller holding mechanism 130 is in the design point, that is, the ideal state.

Suppose that when such an ideal state changes to a state as shown in FIG. 3B in which the relative position between the photosensitive drum holding member 131Y and the transfer roller holding mechanism 130 has shifted in the Z-Z' direction. In this case, a reference point of the transfer roller holding mechanism 130 shifts from C to C' with respect to a position B of the central axis of the photosensitive drum 31Y.

As shown in FIG. 3B, although the distance between the transfer roller holding mechanism 130 and the photosensitive drum holding member 131Y in the Z-axis direction increases, the flat surface 133*t* of the transfer roller holding member 133Y is kept abutted with the circular part 131*a* of the photosensitive drum holding member 131Y.

In other words, although the transfer roller holding member 133Y moves along the reference surface 132*s* of the first guide member 132*b* in the Z' direction with respect to the transfer roller holding mechanism 130, the relative position between the transfer roller holding member 133Y and the photosensitive drum holding member 131Y does not vary.

As a result, a distance H1 between a rotation axis of the photosensitive drum 31Y and a rotation axis of the primary transfer roller 34Y in the Z-Z' direction does not vary, and accordingly the press stroke L2 of the intermediate transfer belt 11 applied by the primary transfer roller 34Y does not vary.

Here, suppose that the transfer roller holding member 133Y is not forced toward the reference surface 132*s* by the plate spring 134, and the attitude of the transfer roller holding member 133Y inclines with respect to the reference surface 132*s*. In this case, the tangent line of the transfer roller holding member 133Y that is tangent to the circular part 131*a* of the photosensitive drum holding member 131Y inclines. This shifts an abutting point where the transfer roller holding member 133Y abuts with the photosensitive drum holding member 131Y, and also varies the distance H1 between the rotation axis of the photosensitive drum 31Y and the rotation axis of the primary transfer roller 34Y in the Z-Z' direction.

With the variation of the distance H1, the value of the press stroke L2 of the intermediate transfer belt 11 applied by the primary transfer roller 34Y varies. Accordingly, in order to prevent variation of the value of the press stroke L2, it is preferable to press the transfer roller holding member 133Y to the reference surface 132*s* using the plate spring 134.

Also, suppose that the ideal state shown in FIG. 3A changes to a state as shown in FIG. 3C in which the relative position has shifted in the X-X' direction, and the reference point of the transfer roller holding mechanism 130 shifts from C to C" with respect to the position B of the central axis of the photosensitive drum 31Y.

In this case, as shown in FIG. 3C, with the shift of the positional variation of the transfer roller holding mechanism 130, the distance between the transfer roller holding member 133Y and the photosensitive drum holding member 131Y increases in the X-axis direction. However, the distance between the transfer roller holding member 133Y and the photosensitive drum holding member 131Y does not vary in the Z-axis direction.

In other words, the press stroke L2 of the intermediate transfer belt 11 applied by the primary transfer roller 34Y does not vary.

Furthermore, suppose that the ideal state shown in FIG. 3A changes to a state as shown in FIG. 3D in which the attitude of the photosensitive drum holding member 131Y inclines, the relative position between the photosensitive drum holding member 131Y and the transfer roller holding mechanism 130 shifts in the X-X' direction, and the reference point of the transfer roller holding mechanism 130 shifts from C to C'" with respect to the position B of the central axis of the photosensitive drum 31Y.

In this case, as shown in FIG. 3D, with the shift of the positional variation of the transfer roller holding mechanism 130, the distance between the transfer roller holding member 133Y and the photosensitive drum holding member 131Y increases in the X-axis direction. However, the distance between the transfer roller holding member 133Y and the photosensitive drum holding member 131Y does not vary in the Z-axis direction.

The reason is as follows. When viewed in the axis direction of the primary transfer roller 34Y (Y-Y' direction), the center of the curvature radius of the circular part 131*a* of the photosensitive drum holding member 131Y that abuts with the flat surface 133*t* is located in a position corresponding to a position of the rotation axis of the photosensitive drum 31Y. Accordingly, the position of the photosensitive drum holding member 131Y does not vary in the Z-axis direction even if the attitude of the photosensitive drum holding member 131Y inclines. As a result, the value of the press stroke L2 of the intermediate transfer belt 11 applied by the primary transfer roller 34Y does not vary.

Although it is considered that one or more of the cases shown in FIGS. 3B-3D actually occur, the press stroke L2 of the intermediate transfer belt 11 applied by the primary transfer roller 34Y does not vary, it is possible to set the contact pressure between the photosensitive drum 31Y and the intermediate transfer belt 11 with a high accuracy.

<Settings of Force Applied by Plate Spring 134>

In order to achieve the above-described effects, it is necessary to ensure that the attitude of the transfer roller holding member 133Y does not incline at any time, in other words, that the transfer roller holding member 133Y moves in a direction perpendicular to a running surface of the intermediate transfer belt 11 along the reference surface of the guide member.

Figure 4:
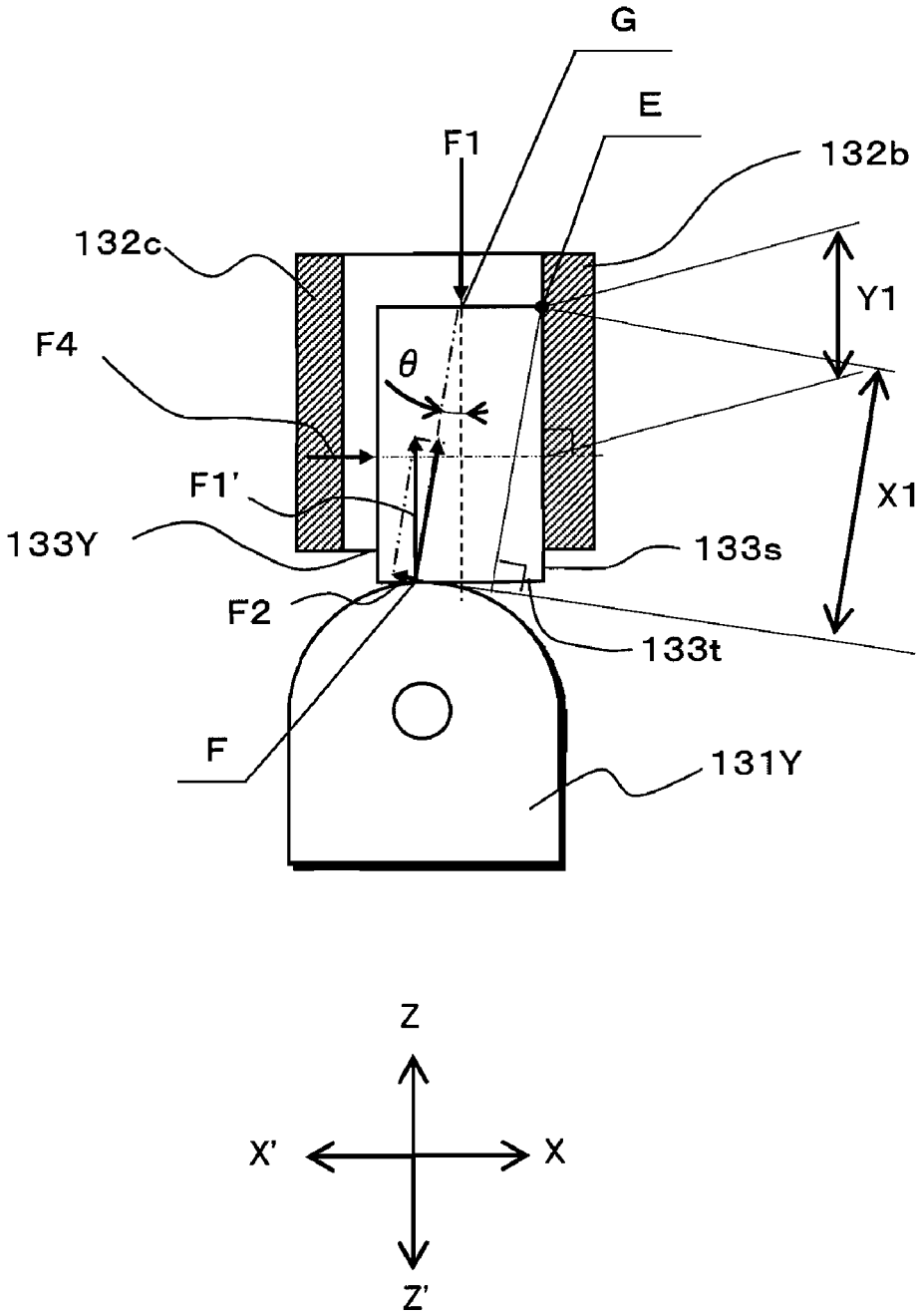
FIG. 4 is a pattern view showing a relationship (1) between a rotation moment applied to the holding member for the primary transfer roller relating to the embodiment of the present invention and a force applied to a reference surface.

The attitude of the transfer roller holding member 133Y inclines due to the following cause. As shown in FIG. 4, the compression coil spring 136 applies a pressing force F1 to the center of a top part of the transfer roller holding member 133Y (hereinafter, "application point G") downward in the perpendicular direction (Z' direction), and a line connecting the application point G and the abutting point F where the transfer roller holding member 133Y abuts with the photosensitive drum holding member 131Y inclines in the perpendicular direction by an angle of θ.

In view of this, the present inventor has conceived of, as shown in FIG. 4, in order to apply a moment to an upper end of the transfer roller holding member 133Y of the right flat surface 133*s* (hereinafter, "point E"), it is necessary that a moment M1 caused by a pressing force F4 applied by the plate spring 134 opposes a direction to a rotation moment M2 caused by a pressing force F1 applied by the compression coil spring 136 and is greater than the rotation moment M2.

Here, as shown in FIG. 4, a reaction force F1' against the pressing force F1 is generated at an abutting point F between the photosensitive drum holding member 131Y and the flat surface 133*t*.

It is considered that, at the abutting point F, a force F2, which is a component force from the reaction force F1' in a direction perpendicular to a straight line connecting the application point G and the abutting point F, applies for rotating around the center of the point E. Accordingly, when a length of a perpendicular line from the point E to a line of action of the component force F2 is X1, the rotation moment M2 is obtained by calculating X1×F1×SIN θ.

On the other hand, when a length of a perpendicular line from the point E to a line of action of the pressing force F4 is Y1, the moment M1 is obtained by calculating Y1×F4.

Accordingly, in this model, in order to keep the right flat surface 133*s* in contact with the reference surface 132*s*, it is necessary to satisfy the following Formula 1.

$$F4 \times Y1 > X1 \times F1 \times \mathrm{SIN}\ \theta \qquad \text{Formula 1}$$

Note that, actually, the rotation moment at the point E is also affected by a frictional force generated at the abutting point F or a force applied to the primary transfer roller 34Y by the intermediate transfer belt 11.

Accordingly, in the case where the frictional force generated at the abutting point F and a force applied to the primary transfer roller 34Y by the intermediate transfer belt 11 are great, these forces need to be reflected in the above Formula 1.

In view of this, as an actual design method, it is realistic to check the actual value of the rotation moment by performing tests or the like to determine the force to be applied by the plate spring 134. In other words, it is preferable to set a pressing force to be applied by the plate spring 134 sufficiently large to keep the right flat surface 133*s* in contact with the reference surface 132*s*.

In the embodiment, in order to achieve a desired efficiency of the primary transfer, it is necessary to suppress the variation of the press stroke L2 of the intermediate transfer belt 11 within a range of plus or minus 75 μm in consideration the accidental error in assembly, the dimensional tolerance of units, and so on.

Under such a strict constrained condition, in the case where the plate spring 134 is not provided and one or more spaces of approximately 100 μm in total are generated beside the transfer roller holding member 133Y in the X-X' direction, this causes variation of as much as 16 μm to 62 μm in the press stroke L2. As a result, it is necessary to improve the dimensional accuracy of other components and the accuracy of assembling.

In the embodiment, by providing the plate spring 134, inclination of the transfer roller holding member 133 causes no variation in the press stroke L2 of the intermediate transfer belt 11. There occurs variation in the press stroke L2 only due to the dimensions of the components.

This results in margin for the dimensional accuracy of other components and the accuracy of assembling.

As described above, the printer 1 relating to the embodiment has the structure in which the relative position between the photosensitive drum holding member 131Y and the transfer roller holding member 133Y does not vary in the direction (Z-Z' direction) perpendicular to the running surface of the intermediate transfer belt 11 (X-Y plain face).

The same applies to the photosensitive drum holding members and the transfer roller holding members that correspond to other colors.

Accordingly, it is possible to strictly set the press stroke L2 of the intermediate transfer belt 11 applied by the primary transfer rollers 34Y-34K.

This allows the settings of the contact pressure between the photosensitive drums 31Y-31K and the intermediate transfer belt 11 with a high accuracy, and suppresses the reduction of the primary transfer efficiency.

Note that the running surface of the intermediate transfer belt 11 here indicates an outer circumferential surface of the intermediate transfer belt 11 which the primary transfer roller (s) 34Y(-34K) has not yet pressed, which corresponds to a running section on which primary transfer is to be performed However, since the press stroke L2 of the intermediate transfer belt 11 applied by the primary transfer roller(s) 34Y (-34K) falls within a range of 0.01 mm to 0.12 mm, the state of outer circumferential surface of the intermediate transfer belt 11 does not substantially change between before and after the intermediate transfer belt 11 has been pressed.

Modification Example

The present invention is not limited to the above embodiment, and it may be possible to employ the following modification examples.

(1) In the above embodiment, the plate spring 134 forces the X direction lateral surface of each of the transfer roller holding members 133Y-133K toward the reference surface 132*s* of the first guide member 132*b*. However, the present invention is not limited to this structure.

For example, it may be possible to replace the position of the reference surface 132*s* with the position of the plate spring 134, and cause the X' direction lateral surface of each of the transfer roller holding members 133Y-133K to force the reference surface.

In this case, the force to be applied by the plate spring 134 that is necessary for keeping the side surface in contact with the reference surface differs between before and after the position of the reference surface 132*s* has been replaced with the position of the plate spring 134.

Figure 5:
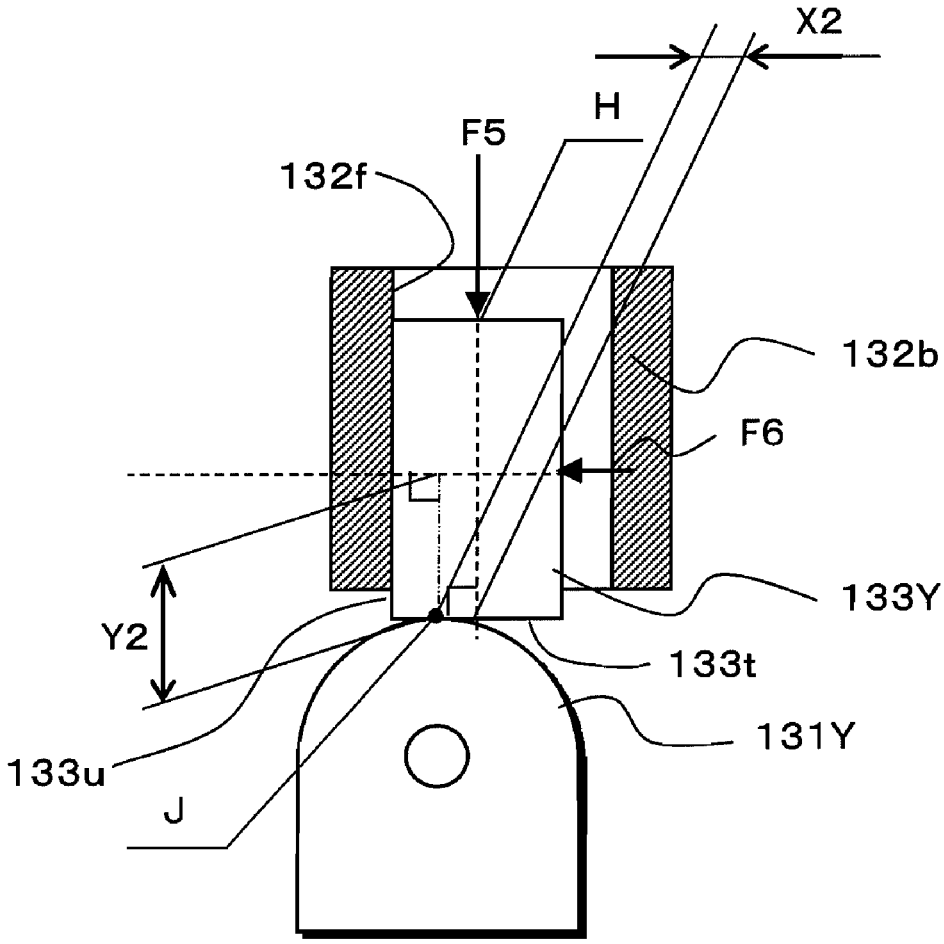
FIG. 5 is a pattern view showing a relationship (2) between the rotation moment applied to the holding member for the primary transfer roller relating to the embodiment of the present invention and the force applied to the reference surface.
Figure 5:
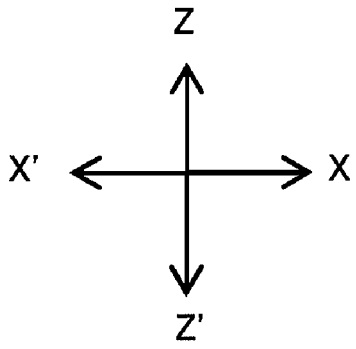

FIG. 5 is a pattern view showing a relationship between a rotation moment applied to the transfer roller holding member 133Y and a force applied to the reference surface in the case after the replacement of the positions has been performed.

In this case, the force applied to the primary transfer roller 34Y by the intermediate transfer belt 11 is not considered.

As shown in FIG. 5, the compression coil spring 136 applies a pressing force F5 downward in the perpendicular direction (Z' direction) to the center of the top part (hereinafter, "point H") of the transfer roller holding member 133Y.

Here, a rotation moment is taken into consideration, which is applied to a point J where the transfer roller holding member 133Y abuts with the photosensitive drum holding member 131Y.

When a length of a perpendicular line from the point J to a line of action of the pressing force F5 is X2 and a rotation moment due to the pressing force F5 at the point J is M3, M3=X2×F5 is satisfied.

This rotation moment M3 applies in the clockwise direction around the point J. In other words, the rotation moment M3 applies in a direction in which a force acts to prevent a left flat surface 133*u* from contacting with a reference surface 132*f*.

Accordingly, in order to keep the left flat surface 133*u* in contact with the reference surface 132*f*, the X direction lateral surface of the transfer roller holding member 133Y needs to be pressed in the X' direction such that a rotation moment M4 greater than the rotation moment M3 is generated in a direction opposite to the direction of the rotation moment M3.

When this pressing force is F6 and a length of a perpendicular line from the point J to a line of action of the pressing force F6 is Y2, the rotation moment M4 is obtained by calculating M4=X2×F5.

Accordingly, in order to keep the left flat surface 133*u* in contact with the reference surface 132*f* in this model, the following Formula 2 needs to be satisfied.

$$F6 \times Y2 > F5 \times X2 \qquad \text{[Formula 2]}$$

Note that, in fact, a rotation moment at an abutting point J is also affected by a force applied to the primary transfer roller 34Y by the intermediate transfer belt 11. Accordingly, just because the above Formula 2 is satisfied, it is not ensured that the right flat surface 133*s* is kept in contact with the reference surface 132*s*.

Actually, it is preferable to check the actual value of the rotation moment by performing tests or the like to determine the pressing force F6. In other words, it is only necessary to set the pressing force F6 large sufficiently to keep the left flat surface 133*u* in contact with the reference surface 132*f*.

(2) Also, in the above embodiment, the concave part 132*d* is provided in the second guide member 132*c*, and the plate spring 134 is fit in the concave part 132*d*. However, the present invention is not limited to this structure.

Figure 6:
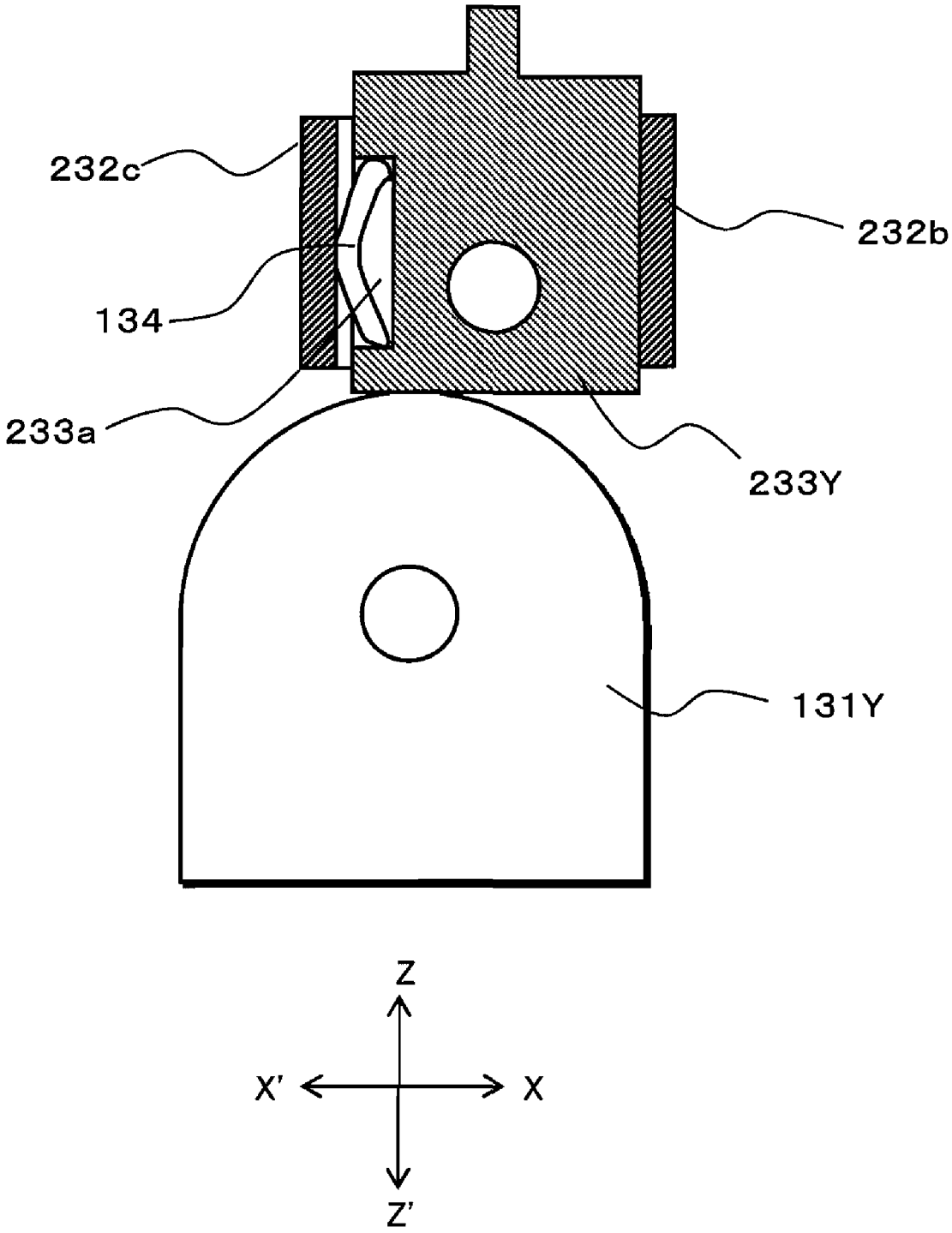
FIG. 6 is a partial cross-sectional view showing a modification example (1) of a member to be used for forcing the holding member for the primary transfer roller relating to the embodiment of the present invention to the reference surface.

For example, the following structure may be employed, as shown in FIG. 6, in which: a concave part 233*a* is provided in a lateral surface of the transfer roller holding member 233Y in the X' direction; a plate spring 134 is fit in the concave part 233*a*; and a transfer roller holding member 233 is provided between a first guide member 232*b* and a second guide member 232*c* that are plate-like and parallel to each other, such that transfer roller holding member 233 is slidable in the Z-axis direction.

(3) Furthermore, in the above embodiment, the plate spring 134 is preferably made of a resin material having excellent elasticity and slidability. However, the present invention is not limited to this.

Figure 7:
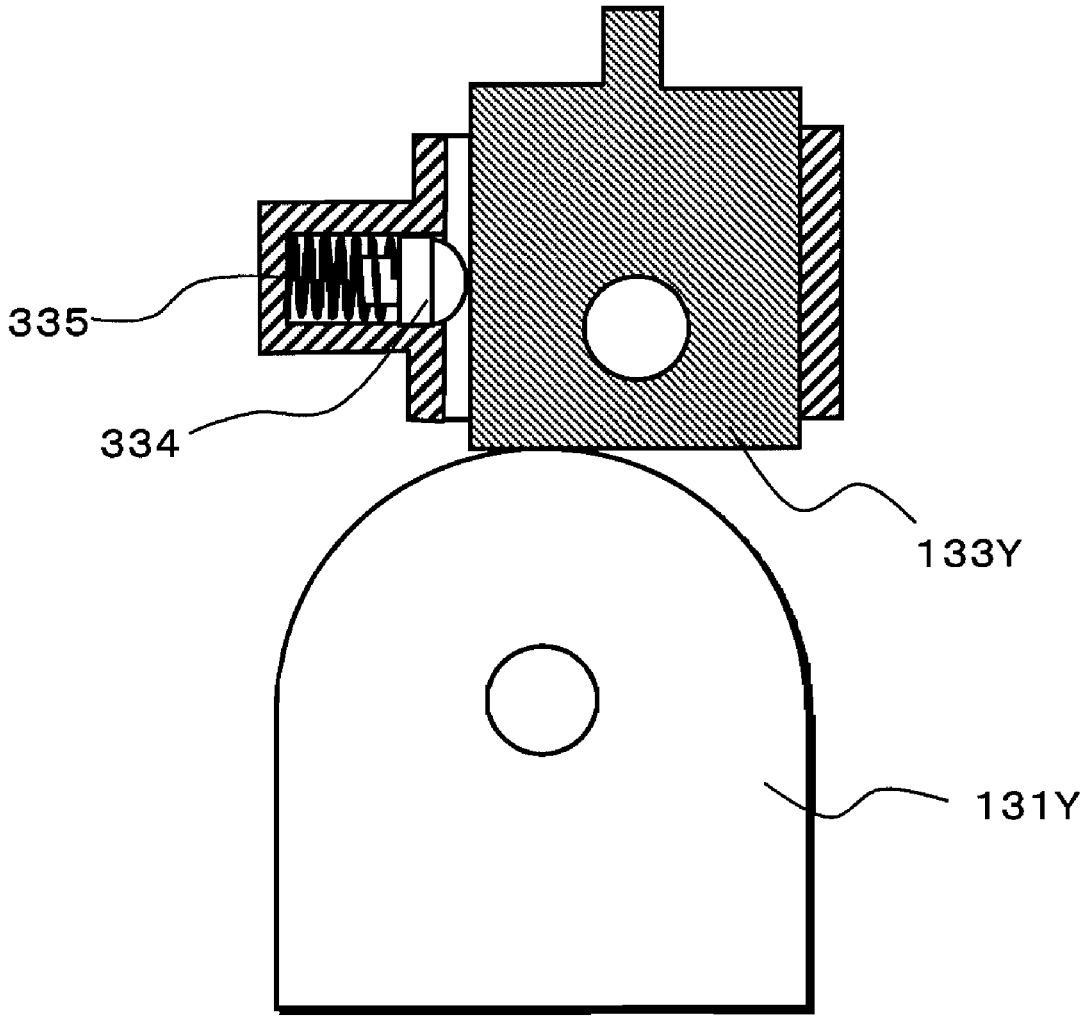
FIG. 7 is a partial cross-sectional view showing a modification example (2) of a member to be used for forcing the holding member for the primary transfer roller relating to the embodiment of the present invention to the reference surface.

For example, the following structure may be employed, as shown in FIG. 7, in which a sliding member 334 having an excellent slidability is fit in one of ends of a compression coil spring 335, and the sliding member 334 is caused to abut with a lateral surface of the transfer roller holding member 133Y or the like.

With such a structure, it is possible to easily set the spring constant by appropriately selecting the linear spring or the number of windings of the spring.

(4) Also, in the above structure, the transfer roller holding member 133Y is caused to press the reference surface 132*s*. This causes the plate spring 134, the compression coil spring 335, and so on to contact with the transfer roller holding member. However, the present invention is not limited to this structure.

Figure 8:
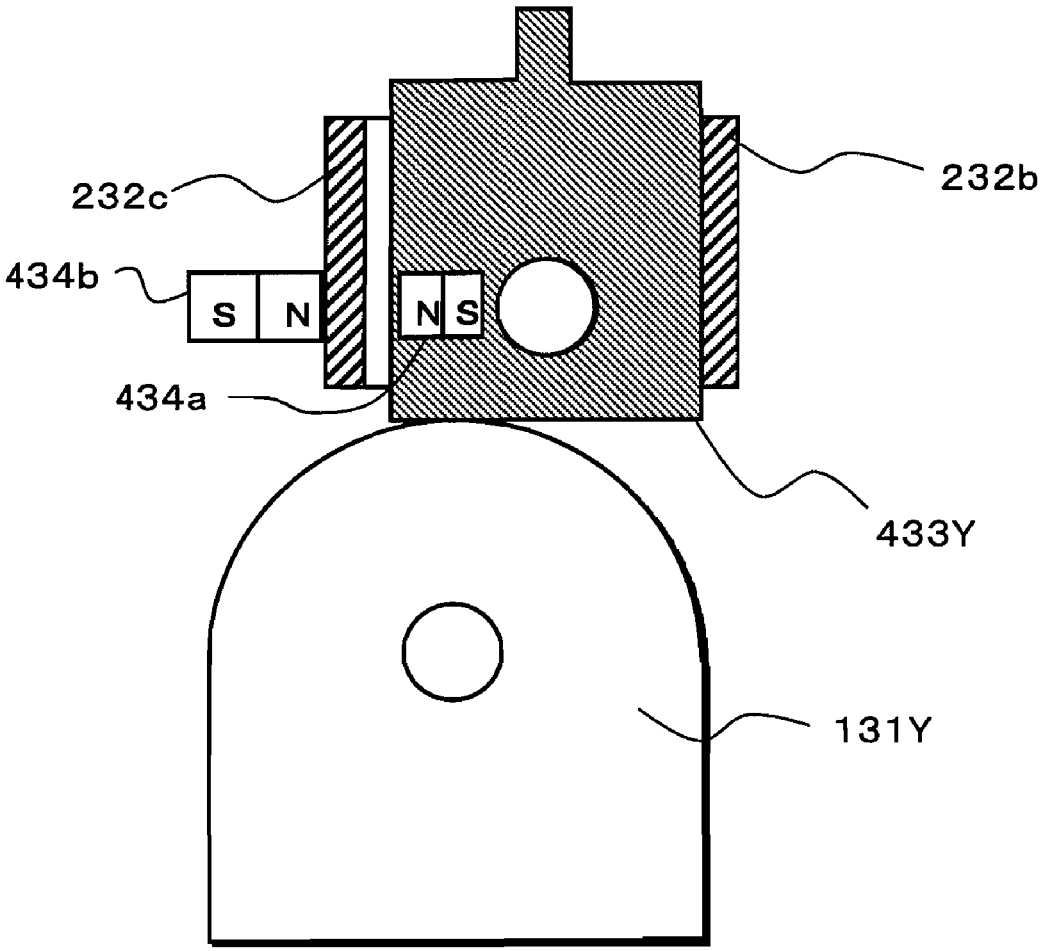
FIG. 8 is a partial cross-sectional view showing a modification example (3) of a member to be used for forcing the holding member for the primary transfer roller relating to the embodiment of the present invention to the reference surface.

For example, the following structure may be employed, as shown in FIG. 8, in which with use of a repulsive force applied between a magnet 434*a* provided in a transfer roller holding member 433Y and a magnet 434*b* provided in a second guide member 232*c*, the transfer roller holding member 433Y is caused to press a first guide member 232*b* by a rejection power.

Figure 9:
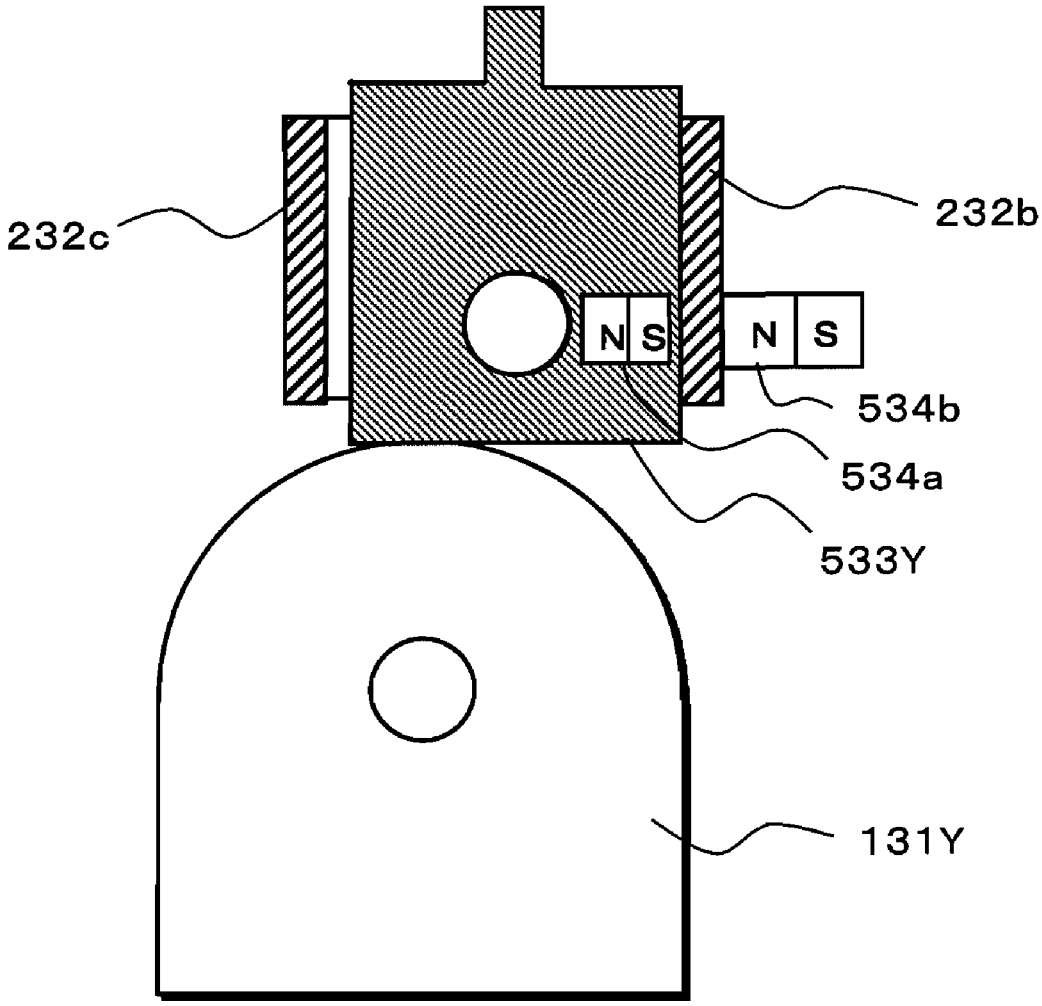
FIG. 9 is a partial cross-sectional view showing a modification example (4) of a member to be used for forcing the holding member for the primary transfer roller relating to the embodiment of the present invention to the reference surface.

Alternatively, the following structure may be employed, as shown in FIG. 9, in which with use of an attractive force applied between a magnet 534*a* provided in a transfer roller holding member 533Y and a magnet 534*b* provided in a second guide member 232*c*, the transfer roller holding member 533Y is pressed to a first guide member 232*b* by a power of absorption.

(5) Furthermore, in the above structure, the plate spring 134 and so on are provided in addition to the transfer roller holding member 133Y. However, the present invention is not limited to this structure.

Figure 10:
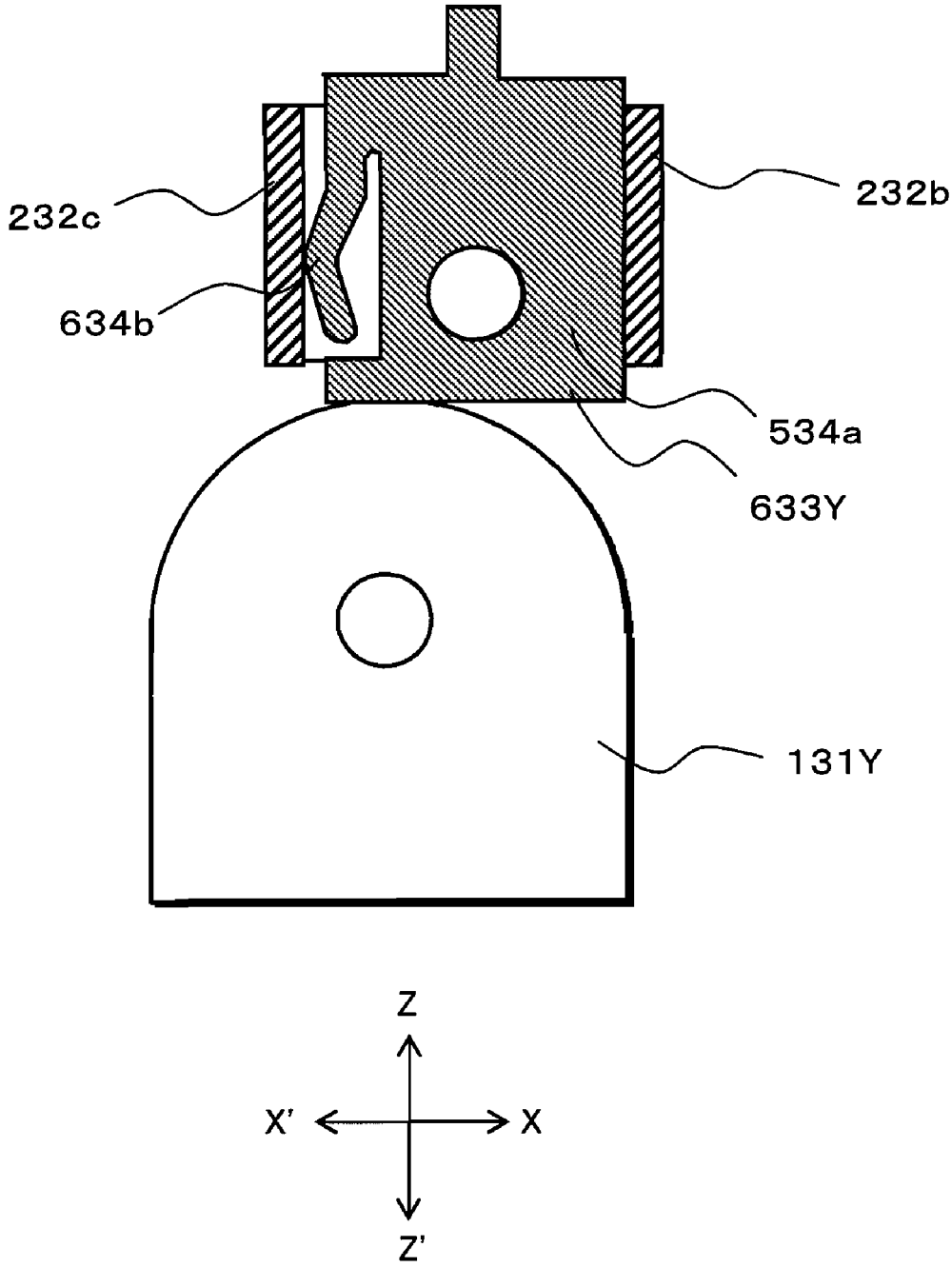
FIG. 10 is a partial cross-sectional view showing a modification example (5) of a member to be used for forcing the holding member for the primary transfer roller relating to the embodiment of the present invention to the reference surface.

For example, the following structure may be employed, as shown in FIG. 10, in which the transfer roller holding member 633Y is forced toward the first guide member 232*b*, by using an elastic deformable part 633*a* that is a leaf spring as one of wall parts of a transfer roller holding member 633Y in the X-axis direction.

In other words, the transfer roller holding mechanism 130 only needs to include a guide unit for guiding the holding member that holds the primary transfer roller along the reference surface while the holding member is kept in contact with the reference surface.

(6) In the above structure, the photosensitive drum holding members 131Y-131K are stabilized, and the transfer roller holding members 133Y-133K are slidable in the direction perpendicular to the running surface of the intermediate transfer belt 11 (Z-axis direction). However, the present invention is not limited to this structure. It may be possible to employ the structure in which the transfer roller holding members 133Y-133K are stabilized, and the photosensitive drum holding members 131Y-131K are slidable in the direction perpendicular to the running surface of the intermediate transfer belt 11.

(7) Furthermore, in the above structure, the top part of each of the photosensitive drum holding members 131Y-131K in the Z direction is circular, and the bottom part of each of the transfer roller holding members 133Y-133K in the Z' direction is the flat surface 133*t*. Alternatively, in some cases, the outlines of the top part in the Z direction and the lower part in the Z' direction may be replaced with each other.

In such a case, it is preferable that a circular arc provided in each of the lower parts of the transfer roller holding members 133Y-133K has the center of the curvature radius that is on the rotation axis of the primary transfer rollers rotatably held by the transfer roller holding members 133Y-133K.

Also, it is preferable to structure the Z direction flat surface of the top part of each of the photosensitive drum holding members 131Y-131K so as to be parallel to the running surface of the intermediate transfer belt 11 as far as possible.

With such a structure, it is possible to determine the relative position between the photosensitive drum and the transfer roller holding member with a high accuracy, in the same way as the printer 1 relating to the above embodiment.

However, in the case where it is acceptable to decrease the accuracy of determining the relative position to some extent between a pair of photosensitive drum holding members (first holding members) 131Y and a pair of transfer roller holding members (second holding members) 133Y for example, the above circular arc does not necessarily need to be a precise circular arc whose center is on the rotation axis of the primary transfer roller. That is, the above circular arc only has to have a convex curved outline.

(8) In the above embodiment, the photosensitive drum 31Y and the primary transfer roller 34Y are offset in the X-X' direction. However, the present invention is not limited to this structure. It may be possible to employ the structure in which the primary transfer roller 34Y is provided directly above the photosensitive drum 31Y, and there occurs no offset as described above.

Even in such a case, while the transfer roller holding member 133Y is sandwiched between the first guide member 132*b* and the second guide member 132*c*, a space of approximately 100 μm is generated beside the transfer roller holding member 133Y in the X-X' direction. Accordingly, a tiny offset is generated. This generates a rotation moment that applies in a direction for cancelling the contact of the right flat surface 133*s* and the reference surface 132*s*.

Accordingly, it is preferable to provide the pressing member such as the plate spring 134 in order to strictly set the press stroke L2 to be applied to the intermediate transfer belt 11 by the primary transfer roller 34Y-34K, irrespective of the positional relationship between the photosensitive drum 31Y and the primary transfer roller 34Y.

(9) Also, in the above embodiment, the description has been provided of the specific size of the transfer roller holding members 133Y-133K and the first guide member 132*b*. However, the size is not limited to the value described above, as far as the transfer roller holding members 133Y-133K are brought in steady contact with the reference surface 132*s* and are abutted with the photosensitive drum holding members, respectively.

(10) Also, in the above structure, the transfer roller holding member 133Y abuts with the photosensitive drum holding member 131Y, in order to determine the relative position between the photosensitive drum 31Y and the primary transfer roller 34Y. However, the present invention is not limited to this structure.

Alternatively, in some cases, the bottom surface 133*t* of the transfer roller holding member 133Y may directly abut with an outer circumferential surface on an end part of the photosensitive drum 31Y.

Figure 11:
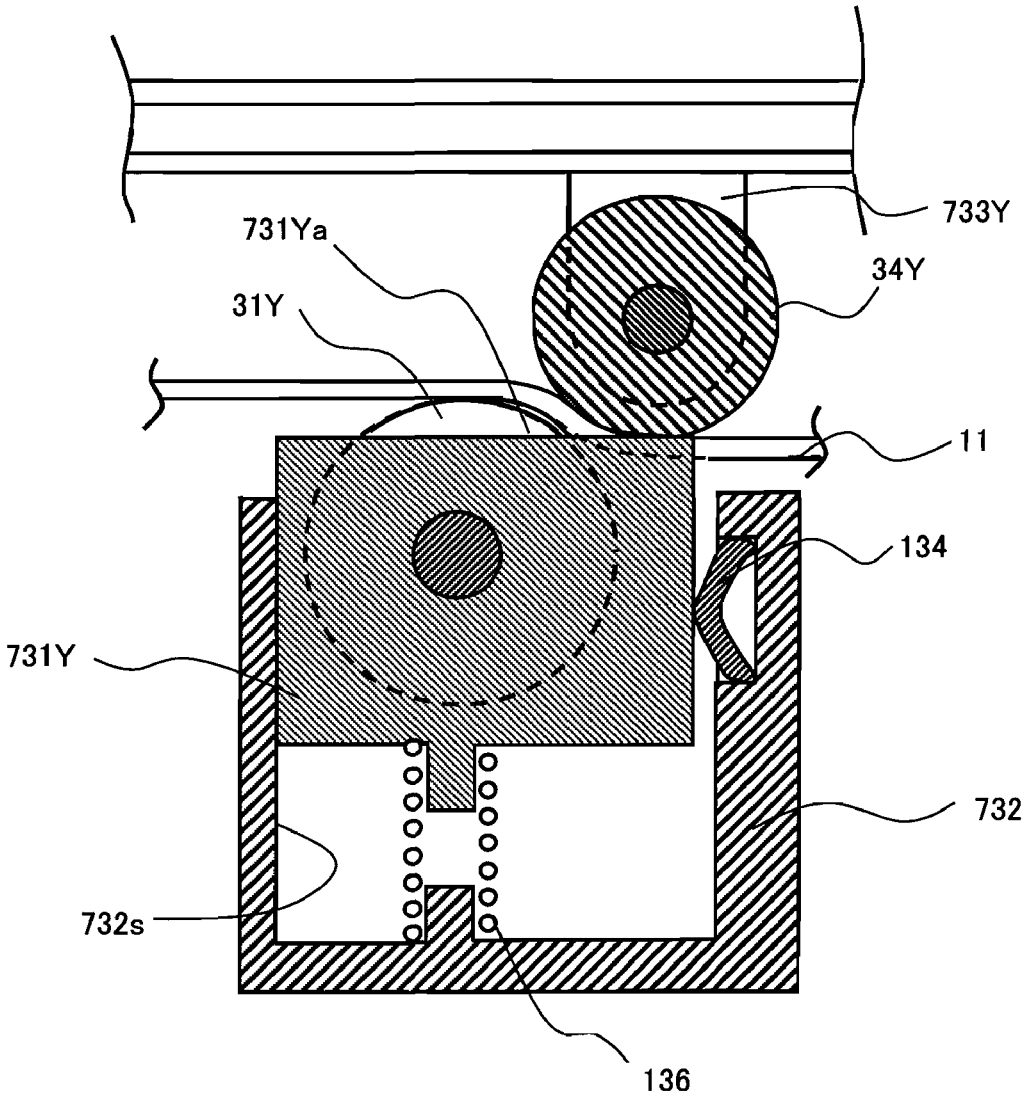
FIG. 11 is a partial cross-sectional view showing a modification example (6) of a member to be used for forcing the holding member for the primary transfer roller relating to the embodiment of the present invention to the reference surface.
Figure 12A:
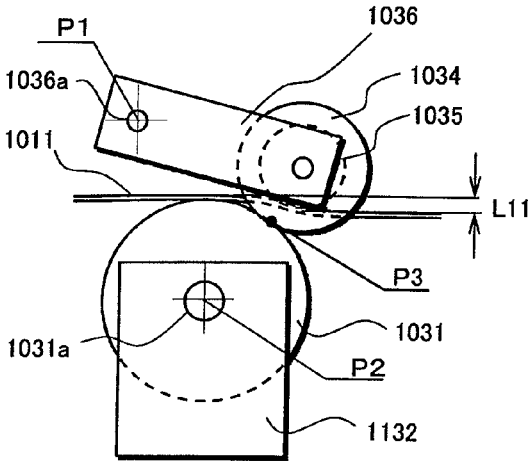
Prior Art FIG.12A
FIG. 12 is a side view showing a holding mechanism of a photosensitive drum and a primary transfer roller of a conventional image forming apparatus.
Figure 12B:
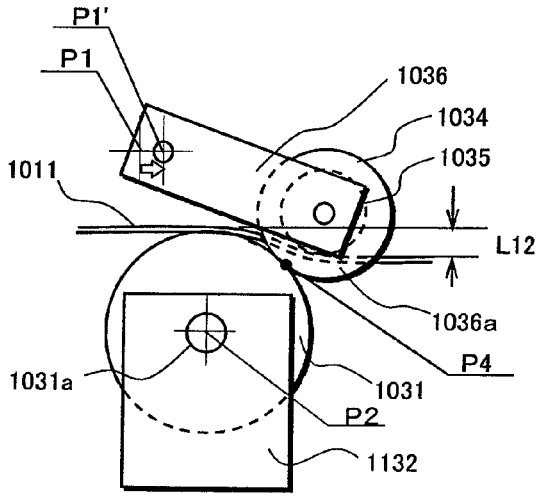
Figure 12C:
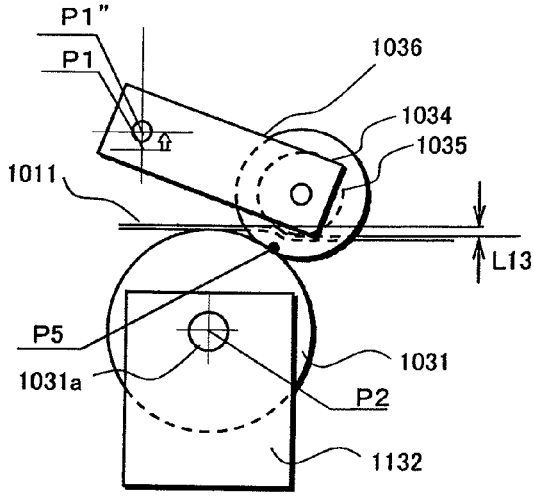
Figure 12C:
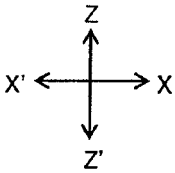

Further alternatively, it may be possible to employ the structure, as shown in FIG. 11, in which a flat surface 731Ya parallel to the running surface of the intermediate transfer belt 11 is provided on a top part of a photosensitive drum holding member 731Y, and the flat surface 731Ya directly abuts with an outer circumferential surface located at an end part of the primary transfer roller 34Y, thereby to determine the relative position between the photosensitive drum 31Y and the primary transfer roller 34Y.

In such a case, it is preferable to structure the transfer roller holding member 133Y and the photosensitive drum holding member 731Y using a material having a high slidability, in order to decrease attrition of the photosensitive drum 31Y and the primary transfer roller 34Y with which the transfer roller holding member 133Y and the photosensitive drum holding member 731Y abut, respectively.

Note that FIG. 11 shows the structure in which the transfer roller holding member 733Y is stabilized; the photosensitive drum holding member 731Y is slidable in the direction perpendicular to the running surface of the intermediate transfer belt 11; and the transfer roller holding member 733Y is forced by the plate spring 134 so as to be in contact with a reference surface 732*s* of a guide member 732 and is further forced by the compression coil spring 136 toward the primary transfer roller 34Y.

(11) In the above embodiment, the description has been provided taking a tandem-type color printer. However, the present invention is not limited to this type printer, and is applicable to any image forming apparatus that transfers a toner image from a photosensitive drum onto a transfer belt.

Although the present invention has been fully described by way of examples with reference to the accompanying drawings, it is to be noted that various changes and modifications will be apparent to those skilled in the art.

Therefore, unless such changes and modifications depart from the scope of the present invention, they should be construed as being included therein.

What is claimed is:

1. An image forming apparatus that transfers a toner image from an image carrier rotary body provided outside an outer circumferential surface of a running belt onto the outer circumferential surface with use of a transfer roller that contacts with an inner surface of the belt, the image forming apparatus comprising:

a first holding member that rotatably holds the image carrier rotary body;

a second holding member that rotatably holds the transfer roller; and a position determining unit operable to determine a relative position between the image carrier rotary body and the transfer roller, by guiding one of the first and second holding members in a direction substantially perpendicular to a running surface of the belt, and abutting a first part of the first holding member and a second part of the second holding member with each other, the first part and the second part opposing each other, wherein when viewed in an axis direction of the transfer roller, one of the first and second parts has a straight linear outline parallel to a running direction of the belt, and the other of the first and second parts has a convex curved outline, and the position determining unit includes:

a guide member having a reference surface extending in the direction substantially perpendicular to the running surface of the belt;

a first forcing member operable to force, toward the reference surface, one of the first and second holding members to be guided, so as to be brought in contact with the reference surface; and a second forcing member operable to force, toward the other holding member, the one holding member to be guided.

2. The image forming apparatus of claim 1, wherein the convex curved outline is a circular arc outline that is concentric with a shaft of one of the first and second holding members having the convex curved outline.

3. The image forming apparatus of claim 1, wherein the first forcing member forces the one holding member to be guided toward the reference surface at a sufficiently large force against a rotation moment due to a reaction force such that the one holding member is kept in contact with the reference surface, the reaction force being applied to the other holding member by the one holding member.

4. The image forming apparatus of claim 1, wherein the first forcing member is a plate spring.

5. The image forming apparatus of claim 4, wherein the plate spring is made of a resin material.

6. The image forming apparatus of claim 1, wherein the first forcing member is a compression coil spring.

7. An image forming apparatus that transfers a toner image from an image carrier rotary body provided outside an outer circumferential surface of a running belt onto the outer circumferential surface with use of a transfer roller that contacts with an inner surface of the belt, the image forming apparatus comprising:

a holding member that rotatably holds the transfer roller; and a position determining unit operable to determine a relative position between the transfer roller and the image carrier rotary body, by guiding the holding member in a direction substantially perpendicular to a running surface of the belt, and abutting a first part of the holding member and a second part of the image carrier rotary body with each other, the first part and the second part opposing each other, wherein when viewed in an axis direction of the transfer roller, the first part has a straight linear outline parallel to a running direction of the belt, and the position determination unit includes:

a guide member having a reference surface provided in the direction substantially perpendicular to the running surface of the belt;

a first forcing member operable to force the holding member toward the reference surface so as to be brought in contact with the reference surface; and a second forcing member operable to force the holding member toward the image carrier rotary body.

8. An image forming apparatus that transfers a toner image from an image carrier rotary body provided outside an outer circumferential surface of a running belt onto the outer circumferential surface with use of a transfer roller that contacts with an inner surface of the belt, the image forming apparatus comprising:

a holding member that rotatably holds the image carrier rotary body; and a position determining unit operable to determine a relative position between the image carrier rotary body and the transfer roller, by guiding the holding member in a direction substantially perpendicular to a running surface of the belt, and abutting a first part of the holding member and a second part of the transfer roller with each other, the first part and the second part opposing each other, wherein when viewed in an axis direction of the image carrier rotary body, the first part has a straight linear outline parallel to a running direction of the belt, and the position determination unit includes:

a guide member having a reference surface provided in the direction substantially perpendicular to the running surface of the belt;

a first forcing member operable to force the holding member toward the reference surface so as to be brought in contact with the reference surface; and a second forcing member operable to force the holding member toward the transfer roller.

* * * * *